US008087630B1

(12) United States Patent
Matthews

(10) Patent No.: US 8,087,630 B1
(45) Date of Patent: Jan. 3, 2012

(54) WIND-RESISTANT STACKABLE CUP HOLDERS

(75) Inventor: Loren Michael Matthews, Ft Lauderdale, FL (US)

(73) Assignee: Zoya, Inc., Fort Lauderdale, FL (US)

( * ) Notice: Subject to any disclaimer, the term of this patent is extended or adjusted under 35 U.S.C. 154(b) by 156 days.

(21) Appl. No.: 12/590,294

(22) Filed: Nov. 5, 2009

Related U.S. Application Data

(63) Continuation-in-part of application No. 11/035,872, filed on Jan. 10, 2005, now abandoned.

(51) Int. Cl.
*A47K 1/08* (2006.01)

(52) U.S. Cl. ..... 248/311.2; 248/156; 248/346.05; 248/346.11

(58) Field of Classification Search ..... 248/311.2, 248/346.01, 346.05, 346.11, 87, 156
See application file for complete search history.

(56) References Cited

U.S. PATENT DOCUMENTS

| | | | | |
|---|---|---|---|---|
| 1,705,501 | A * | 3/1929 | Sas | 273/339 |
| 1,831,308 | A | 6/1929 | Kuck | |
| D166,368 | S | 4/1952 | Wenander | |
| 3,529,742 | A * | 9/1970 | Cumming | 220/606 |
| 4,101,049 | A | 7/1978 | Wallace et al. | |
| 4,198,048 | A * | 4/1980 | Rathert | 273/339 |
| 4,858,872 | A | 8/1989 | Witt | |
| 4,928,876 | A * | 5/1990 | Marshall | 229/103.1 |
| 5,203,531 | A | 4/1993 | Gracon | |
| 5,620,185 | A * | 4/1997 | Robertson | 273/338 |
| 6,102,352 | A | 8/2000 | Kvalvog | |
| 6,149,119 | A * | 11/2000 | O'Connell | 248/545 |
| 6,364,151 | B1 | 4/2002 | Gale | |
| 6,533,140 | B1 * | 3/2003 | Freeman | 220/737 |
| 7,017,746 | B2 | 3/2006 | Apps | |
| 7,516,931 | B2 * | 4/2009 | Sarullo | 248/311.2 |
| 2006/0091275 | A1 | 5/2006 | Roberts | |

* cited by examiner

*Primary Examiner* — Amy Sterling
(74) *Attorney, Agent, or Firm* — Ronald V. Davidge

(57) ABSTRACT

A cup holder includes a base having a cup-receiving central portion, a number of cup holding elongated members extending upward around the central portion to hold a cup in place so that it is not overturned or blown away by the wind, and a number of openings extending upward from a lower surface of the base to receive the cup holding elongated members of another, similar cup holder so that the cup holders can be stacked for storage. The cup holder may include a removably attached, downward extending member for attachment to a soft soil surface. In one version, the cup holding elongated members and the openings are tapered, with the openings extending within the cup holding elongated members. In other versions, the openings are placed within the base in patterns similar to the pattern of the cup holding elongated members, with the patterns being spaced apart from one another.

7 Claims, 6 Drawing Sheets

WIND-RESISTANT STACKABLE CUP HOLDERS

CROSS REFERENCE TO A RELATED APPLICATION

This application is a continuation in part of U.S. application Ser. No. 11/035,872. filed Jan. 10, 2005 now abandoned.

BACKGROUND OF THE INVENTION

1. Field of the Invention

This invention relates to cup holders or coasters, and, more particularly to such items being configured to be stackable and to prevent light weight cups held therein from being overturned or blown off a table by the wind.

2. Summary of the Background Art

Paper or plastic cups are often used outdoors under windy conditions with a result that empty or nearly empty cups are overturned or blown off tables, causing liquids to be spilled and causing trash to accumulate. Such problems may occur in private residences and in restaurants.

Coasters of many types are widely used for placement under drinking glasses or cups, primarily to prevent contact between the furniture surfaces on which the glasses or cups are placed and the hot or cold surfaces of the glasses or cups or with liquids formed by condensation on the surfaces of the glasses or cups. Such coasters are typically stackable for storage, with interlocking surfaces being provided to hold the coasters stacked in place, or with the coasters simply being stackable due to their flat and parallel upper and lower surfaces. The patent literature includes several examples of stackable coasters. For example, U.S. Design Pat. No. 166, 368 describes a set of coasters that are held in a stacked condition by a package, while U.S. Pat. No. 5,385,326 describes coasters that are keyed so that they can only be stacked in one configuration, in which graphical information is displayed on the peripheral surface of the coasters. However, since such coasters have, at most, a small lip surrounding a cup-receiving surface, they cannot hold an empty, or nearly empty paper or plastic cup in place when it is being blown by a substantial wind.

U.S. Pat. No. 5,203,531 describes a device for holding a stack of light tapered paper cups in an inverted orientation so that the cups cannot be easily knocked down by the wind. Several embodiments are described, each of which includes a base with an annular surface for receiving the edge of the lowermost cup in an inverted stack of cups and a member or an adjustable group of members extending upward inside this annular surface for engaging the inner surface of this lowermost cup. Still, what is needed is a wind-resistant cup holder for holding a single cup in its upright orientation so that it can be used as a coaster while preventing a light-weight cup from being overturned or blown away by the wind.

U.S. Pat. No. 6,364,151 describes a cup holder comprising a single molded piece having at least three upstanding segments interconnected by hinges, so that the segments are retained in a circular configuration while being outwardly inclined having a size substantially less than the size of the top rim of the cup and an upper aperture greater in size than the lower aperture, permitting the cup holder to be nested before use. The hinges permit the lower extremity of the segments to be cammed outwardly as a cup is introduced through the upper aperture and through the lower aperture to engage the lower extremities of the segments and cam the lower extremities of the segments outwardly to thereby increaser the size of the lower aperture, permitting the cup to continue moving therethrough, camming the lower extremities of the segments inwardly to come into frictional engagement with the side walls of the cup. The cup is then frictionally retained in the holder between the top rim and the bottom end, so that the cup can be carried by grasping the holder, preventing contact between the user's hand and the hot surface of the cup. What is needed is a cup holder releasably holding a light weight cup while remaining on the table as a coaster when the cup is removed, but while preventing the cup from being blown away or overturned by the wind while the cup is placed in the holder.

SUMMARY OF THE INVENTION

Accordingly, it is a first objective of the invention to provide a cup holder having a base with a central cup receiving upper surface with a number of cup holding elongated members extending upward around the cup-receiving surface, so that a cup placed thereon will not be blown away or overturned by the wind.

It is a second objective of the invention to provide such a cup holder with a ground attachment elongated member, extending downward for attaching the cup holder into a soft soil surface.

It is a third objective of the invention to provide such a cup holder with a number of openings extending upward from a lower surface of the base, so that a number of similar cup holder can be stacked for storage.

According to one aspect of the invention, a cup holder is provided, including a base, a number of cup holding elongated members extending upward from an upper surface of the base, and a ground attachment elongated member extending downward from a lower surface of the base.

Preferably, the cup holder is configured so that a number of such cup holders can be stacked, with the ground attachment elongated members being removed from their bases, and with a number of openings extending upward from a lower surface of the base for receiving cup holding elongated members of a similar cup holder disposed below the cup holder. For example, the base of the cup holder may include a threaded hole engaging a threaded tenon forming part of the ground attachment elongated member.

Preferably, the upper surface of the base includes a central cup-receiving portion and a peripheral portion, extending around the central cup-receiving portion, from which the cup holding elongated members extend upward. Preferably, the central cup holding portion of the upper surface of the base is circular, with the cup holding elongated members being arranged in a circular pattern, and with the openings in the lower surface being arranged in a circular patter to receive cup holding elongated members arranged in a circular pattern.

In one embodiment of the invention, each of the openings in the lower surface of the base extends upward within one of the cup holding elongated members, which each of the cup holding elongated members including one of the openings in the lower surface. Each of the cup holding elongated members is tapered from a larger end at the upper surface of the base to a smaller end at the tip of the cup holding elongated member. Additionally, each of the openings in the lower surface is tapered from a larger end at the lower surface to a smaller end at the top of the opening.

In another embodiment, the cup holding elongated members are arranged along the base in a first pattern, and the openings in the lower surface are arranged in a plurality of patterns, each of which is similar to the first pattern, and, each of which is displaced from the first pattern and from each other pattern in the plurality of patterns. For example, the first pattern may be circular, with each of the patterns in the plurality of patterns being disposed coaxially with the first pattern. Each of the cup holding elongated members may be tapered from a larger end at the base to a smaller end at the top of the cup holding elongated member, with each of the openings in the lower surface being configured to fit on a member similar to each of the cup holding elongated members at a level displaced from the base between the smaller end and the larger end. Alternately, each of the cup holding elongated members may be smaller than each of the openings in the lower surface.

According to another aspect of the invention, a packaged product is provided, including a stack of the cup holders and a number of the ground attachment elongated members.

DETAILED DESCRIPTION OF THE INVENTION

Figure 1:
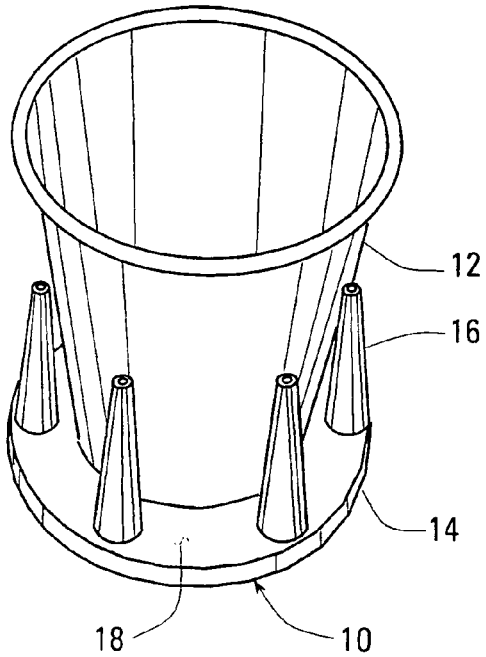
FIG. 1 is a perspective view of a cup holder made in accordance with a first embodiment of the invention holding a cup.
Figure 3:
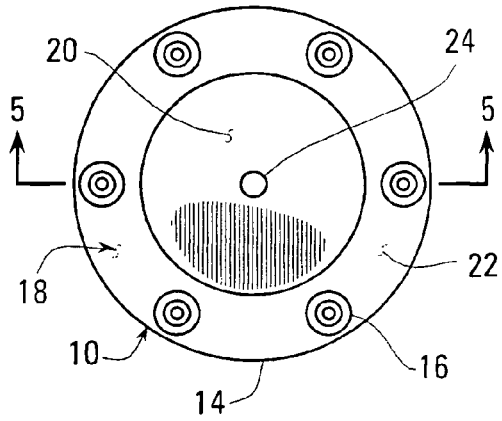
FIG. 3 is a plan view of the cup holder of FIG. 1.
Figure 2:
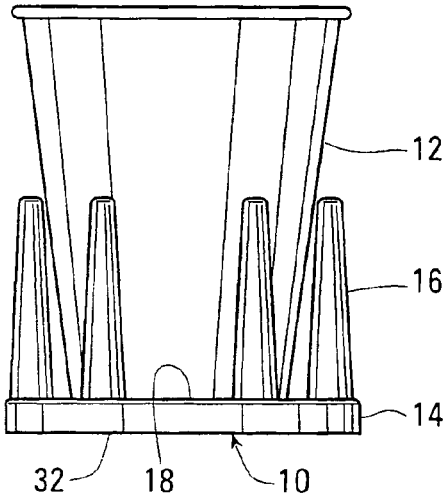
FIG. 2 is an elevation of the cup holder of FIG. 1 holding the cup of FIG. 1.

A cup holder 10 made in accordance with a first embodiment of the invention will first be described in reference to FIGS. 1-3. FIGS. 1 and 2 show the cup holder 10 holding a cup 12, with FIG. 1 being a perspective view and FIG. 2 being an elevation. FIG. 3 is a plan view of the cup holder 10. The cup holder 10 includes a base 14 and a number of cup holding elongated members 16 extending upward from an upper surface 18 of the base 14. The upper surface 18 includes a circular central cup-receiving portion 20 and a peripheral portion 22 extending around the central portion 20, with the cup holding elongated members 16 extending upward from the peripheral portion 22. The cup holder 10 may also include a central hole 24 facilitating the drainage of water from the cup-receiving portion 20. The cup 12 is held in place and prevented from overturning by the cup holding elongated members 16 during windy conditions, with the cup holder 10 preferably being heavy enough to hold the cup 12 in place even when the cup is empty.

Figure 4:
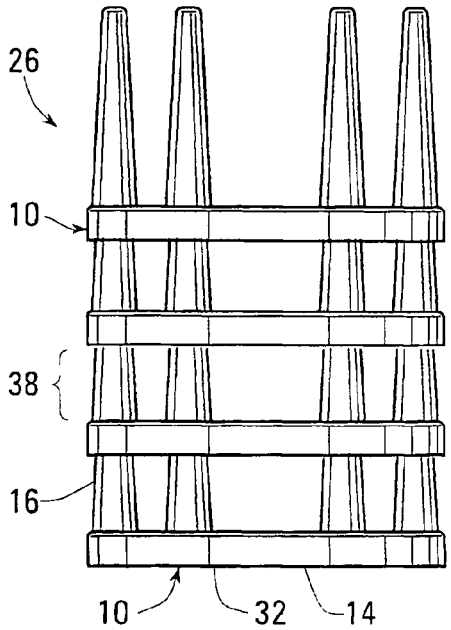
FIG. 4 is an elevation of a stack of four of the cup holders of FIG. 1.
Figure 5:
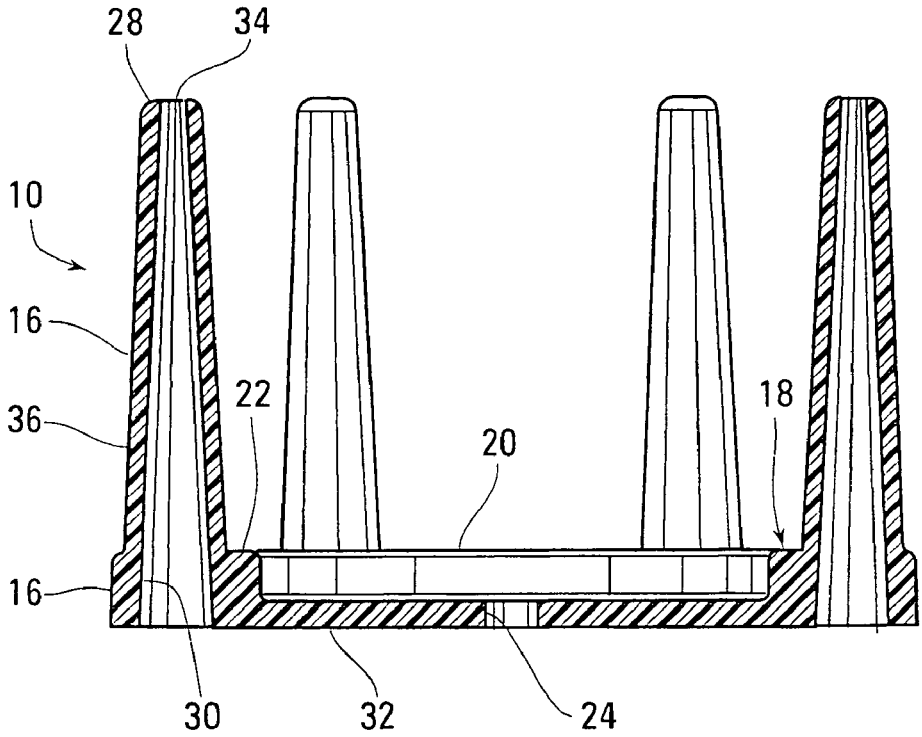
FIG. 5 is a cross-sectional elevation of the cup holder of FIG. 1, taken as indicated by section lines 5-5 in FIG. 3.

Features configured to facilitate the stacking of a number of the cup holders 10 will now be discussed, with particular reference being made to FIGS. 4 and 5. FIG. 4 is an elevation of a stack of four of the cup holders 10, while FIG. 5 is a cross-sectional elevation of the cup holder 10, taken as indicated by section lines 5-5 in FIG. 3. Each of the cup holding elongated members 16 is tapered between a larger size at the upper surface 18 of the base 14 and a smaller size at a tip 28 of the cup holding elongated member 16. The cup holder 10 additionally includes a number of openings 30 extending upward from a lower surface 32 of the base 14, with one of the openings 30 extending within each of the cup holding elongated members 16. Each of the openings 30 is tapered between a larger size at the lower surface 30 of the base and a smaller size at a tip 34 of the opening 30. As also shown in FIG. 5, the cup-receiving portion 20 of the upper surface 18 is offset below the surrounding peripheral portion 18 thereof.

The cup holders 10 can be stacked, as shown in FIG. 4, with the cup holding elongated members 16 of each of the cup holders 10, except for the top cup holder 10 within the stack 26, extending into the openings 28 of the cup holder above the cup holding elongated member 16 within the stack 26. Because of the thickness of the wall 36 between each of the holes 30 and the outer surface of the cup holding elongated member 16 within which the hole 30 extends, the bases 16 of two adjacent cup holders 10 within the stack 26 remain separated by a displacement distance 38 when the cup holding elongated members 16 of the lower cup holder 10 are pushed into the holes 30 of the upwardly adjacent cup holder 10

Figure 6:
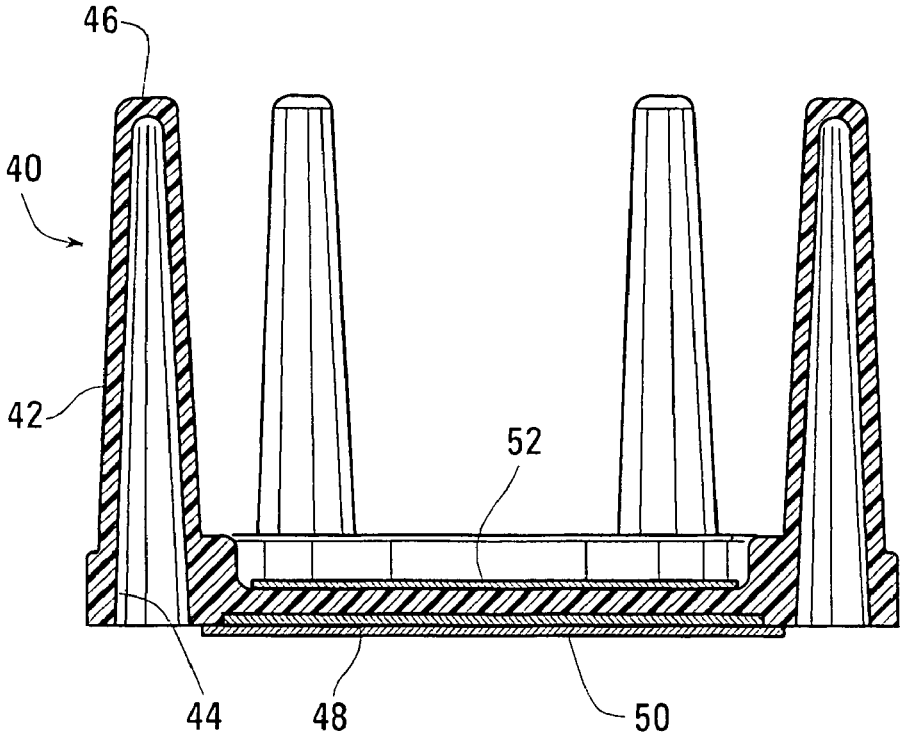
FIG. 6 is a cross-sectional elevation of a cup holder made in accordance with a first embodiment of the invention showing variations applied thereto.

FIG. 6 is a cross-sectional elevation of a cup holder 40 built in accordance with the first embodiment of the invention to incorporate several optional features. For example, each of the cup holding elongated members 42 includes an opening 44 extending upward to a closed tip 46. The cup holder 40, which is composed of a thermoplastic resin, also includes a metal weight 48 to improve wind resistance and a soft pad 50, which may be composed of an elastomeric material, to retard the sliding movement of the cup holder 40 along a table surface during windy conditions. The cup holder 40 may additionally include an absorbent pad 52 to absorb condensation, instead of the drainage hole 24. Other features of the cup holder 40 are as described above in reference to FIGS. 1-5 for the cup holder 10.

Figure 7:
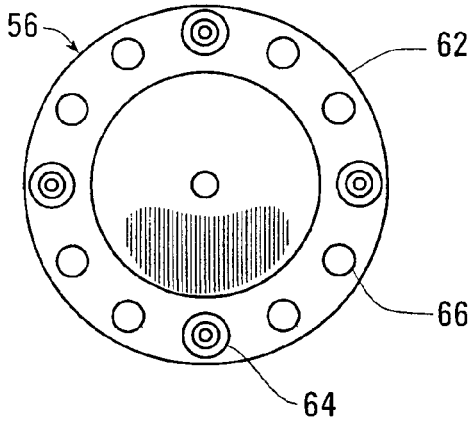
FIG. 7 is a plan view of a cup holder built in accordance with a second embodiment of the invention.
Figure 9:
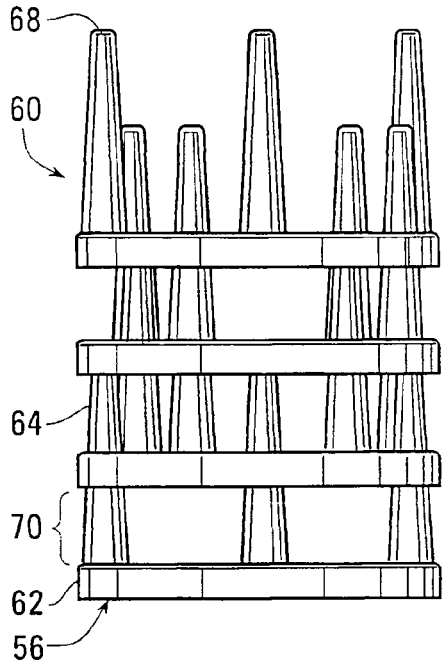
FIG. 9 is an elevation of a stack of four of the cup holders of FIG. 7.
Figure 8:
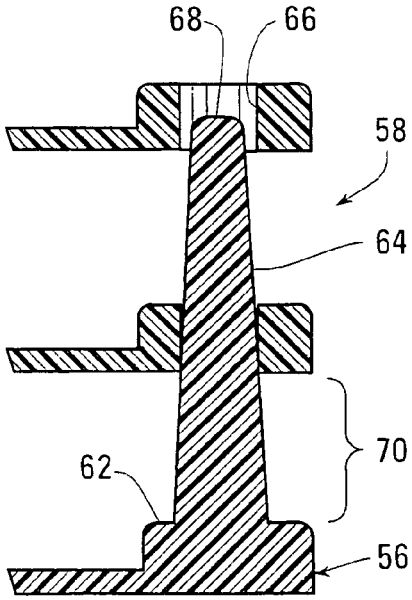
FIG. 8 is a fragmentary cross-sectional elevation of a stack of three of the cup holders of FIG. 7.

A cup holder 56 made in accordance with a second embodiment of the invention will now be described in reference to FIGS. 7-9. FIG. 7 is a plan view of the cup holder 56, while FIG. 8 is a fragmentary cross sectional elevation of a stack 58 of three of the cup holders 56, and while FIG. 9 is an elevation of a stack 60 of four of the cup holders 56. The cup holder 56 includes a base 62 and a number of cup holding elongated members 64 that are arranged in a circular pattern, together with a number of openings 66 extending through the base 62. The openings 66 are arranged in several circular patterns that are each similar to the circular pattern of the cup holding elongated members 64. In the example of FIG. 7, there are four cup holding elongated members 64 arranged in a circular pattern, being evenly spaced around the circular pattern, and two similar circular patterns, each having four openings 66.

Each of the cup holding elongated members 64 is tapered from a large size at the base 62 to a smaller size at a tip 68. The size of the holes 66 is between the large size of the cup holding elongated members 64 and the size of the smaller end at the tip 70, so that when the cup holders 56 are stacked as shown in FIGS. 8, and 9, the bases 62 of adjacent cup holders 56 are spaced apart through a distance 70. Under such conditions, as shown particularly in FIG. 8, each of the cup holding elongated members 64 extends through, at most, two holes 66 within other cup holders 56. Thus, in this exemplary configuration of FIGS. 7-9, any number of cup holders 56 can be stacked with two circular patterns of holes 66 arranged to accept the cup holding elongated members 66 from a single cup holder 56. The cup holding elongated members 64 may be solid, as shown in the example of FIG. 8, or hollow to facilitate the process of making the cup holder 56 by molding a plastic resin.

Figure 10:
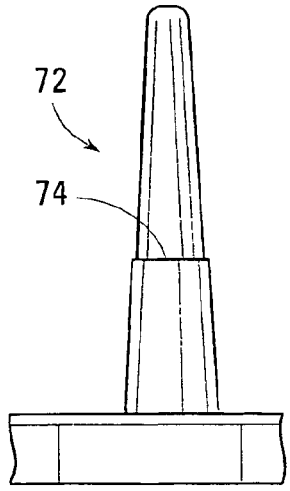
FIG. 10 is a fragmentary elevation showing an alternative construction for a cup holding elongated member in either the cup holder of FIG. 1 or the cup holder of FIG. 7.

FIG. 10 is a fragmentary elevation showing an alternative construction for an cup holding elongated member 72, which may be employed within either a cup holder built in accordance with the first embodiment of the invention, as otherwise described above in reference to FIGS. 1-5 or a cup holder built in accordance with the second embodiment of the invention, as otherwise described above in reference to FIGS. 7-9. The cup holding elongated member 72 is tapered in a stepped fashion, so that a ledge 74 is provided to hold another cup holder adjacently stacked above the cup holder having the cup holding elongated member 72. This ledge 74 has an advantage of reducing the likelihood that the cup holders within a stack may become locked together by being pushed together with too much force.

Figure 11:
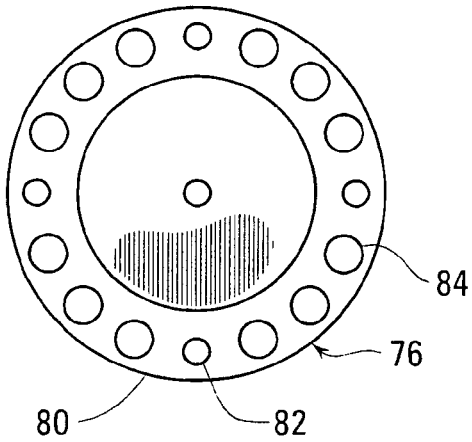
FIG. 11 is a plan view of a cup holder built in accordance with a third embodiment of the invention.
Figure 13:
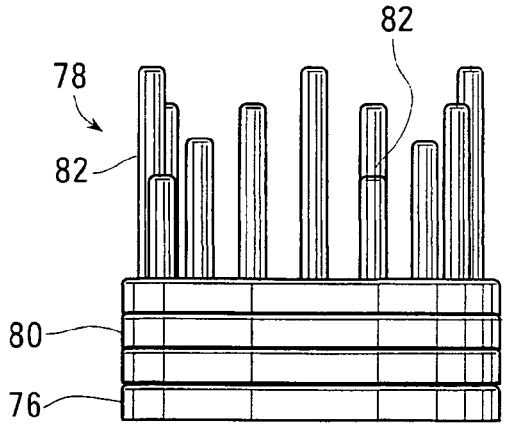
FIG. 13 is an elevation of the stack of cup holders of FIG. 12.
Figure 12:
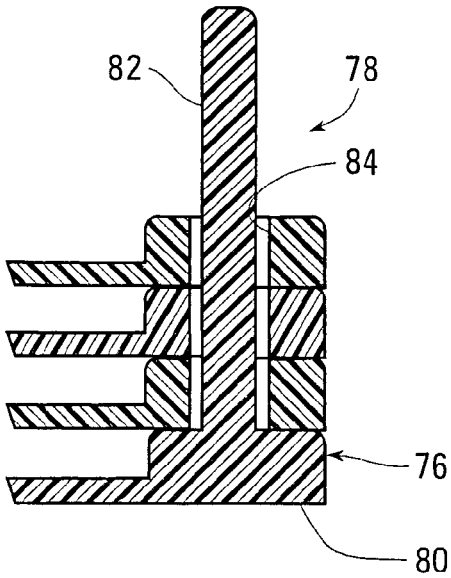
FIG. 12 is a fragmentary cross-sectional elevation of a stack of four of the cup holders of FIG. 11.

A cup holder 76 built in accordance with a third embodiment of the invention will now be discussed, with reference being made to FIGS. 11-13. FIG. 11 is a plan view of the cup holder 76, while FIGS. 12 and 13 show a stack 78 of four of the cup holders 76. FIG. 12 is a fragmentary cross-sectional elevation of this stack 78 of cup holders 76, while FIG. 13 is an elevation thereof. The cup holder 76 includes a base 80 and a number of cup holding elongated members 82 arranged in a circular pattern along the base 80, together with a number of openings 84 extending through the base 80. The openings 84 are arranged in several circular patterns, each of which is similar to the circular pattern of the cup holding elongated members 82.

Each of the openings 84 is larger in size than each of the cup holding elongated members 82, so that, when the cup holders 76 are stacked as shown in FIGS. 12 and 13, the entire length of the cup holding elongated member 82 extends through the openings 84 of upwardly adjacent cup holders 76. In the example of FIGS. 11-13, there are three circular patterns of openings 84, so that four cup holders 76 can be stacked with their bases 80 lying in contact with one another. Additionally, another cup holder 76, or another stack of cup holders 76 may be placed atop the tips 86 of the lowermost cup holding elongated members 82.

Figure 14:
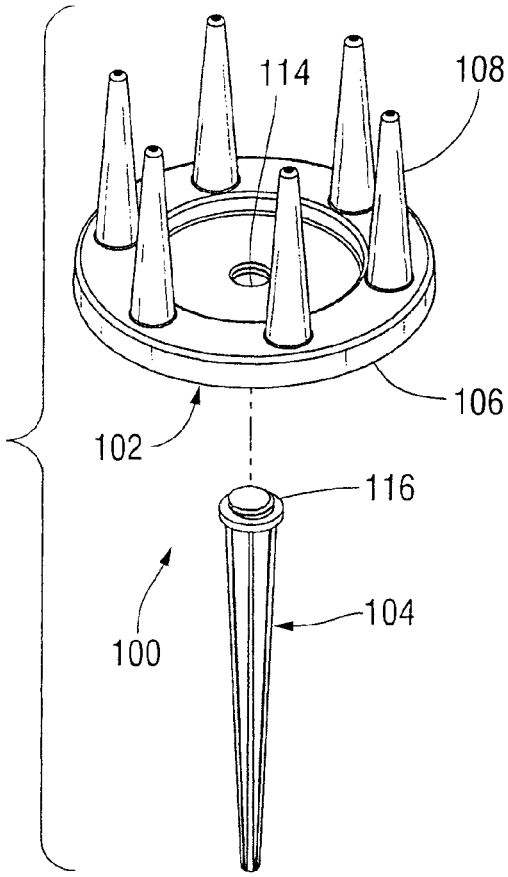
FIG. 14 is a perspective view of a cup holder built in accordance with a fourth embodiment of the invention, showing a ground attachment elongated member in an exploded relationship with a base portion therein.
Figure 15:
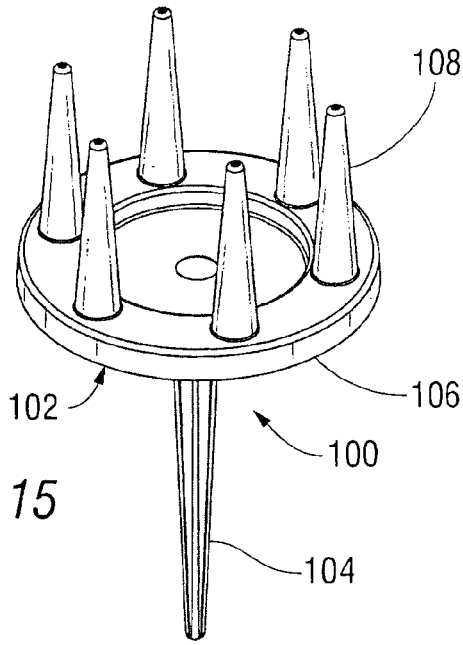
FIG. 15 is a perspective view of the cup holder of FIG. 14, showing the elongated member attached to the base portion.
Figure 16:
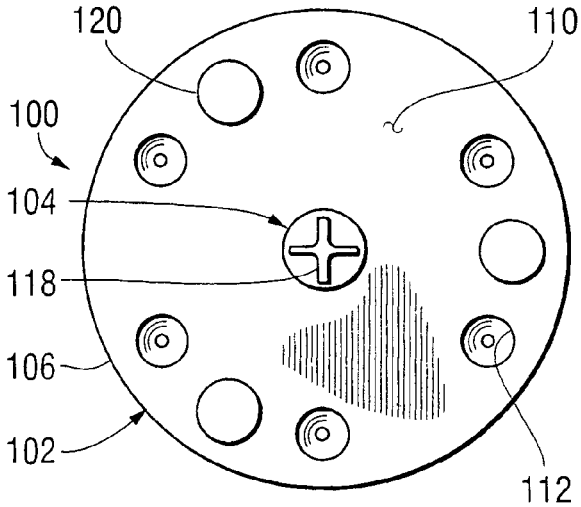
FIG. 16 is a bottom plan view of the cup holder of FIG. 15.

A fourth embodiment of the invention will now be discussed, with reference being made to FIGS. 14-16. FIG. 14 is a perspective view of a cup holder 100 built in accordance with a fourth embodiment of the invention to include a base portion 102 and a ground attachment elongated member 104, shown in an exploded relationship with the base portion 102. FIG. 15 is a perspective view of the cup holder 100, showing the ground attachment elongated member 104 attached to the base portion 102. FIG. 16 is a bottom plan view of the cup holder 100, also showing the elongated member 104 attached to the base portion 102.

The base portion 102 is configured generally as described above in reference to FIGS. 1-5 to include a base 106 and a plurality of cup holding elongated members 108. A lower surface 110 includes a hole 112 extending upward within each of the cup holding elongated members 108, with the holes 112 being arranged to provide spaces for the cup holding elongated members 108 of another base portion 102 disposed in a nested arrangement below the base portion 102, as described above in particular regarding FIG. 4.

The base portion 102 is additionally provided with a threaded central hole 114, which extends upward from the lower surface 110, while the ground attachment elongated member 104 is provided with a threaded tenon 116, configured to engage the threaded central hole 114. In this way, the ground attachment elongated member 104 is removably attached to the base portion 102, allowing the base portion 102 to be used without the ground attachment elongated member 104 to hold a cup on a flat surface, such as an outdoor table, during windy conditions, and alternately, with the ground attachment elongated member 104 attached to the base portion, to hold a cup in place above a ground surface having soft soil penetrated by the ground attachment elongated member 104. For example, a cup may be supported by the ground attachment elongated member 104 next to a lawn chair on a lawn or on the beach. In addition, a number of the base portions 102 may be stacked for storage or transportation when not in use.

Preferably, both the base portion 102 and the ground attachment elongated member 104 are formed from a thermoplastic resin by an injection molding process, with the ground attachment elongated member 104 including a number of outward-extending fins 118. Optionally, the base portion 104 may include soft pads 120 attached within recessed areas, and, as discussed above in reference to FIG. 6 and shown therein, an absorbent pad 52 and a metal weight 48. A metal weight used in this way either includes a clearance hole, allowing the tenon 116 to engage the threaded hole 114 within the base portion 102, or a similar threaded hole, so that the tenon 116 engages the metal weight.

Figure 17:
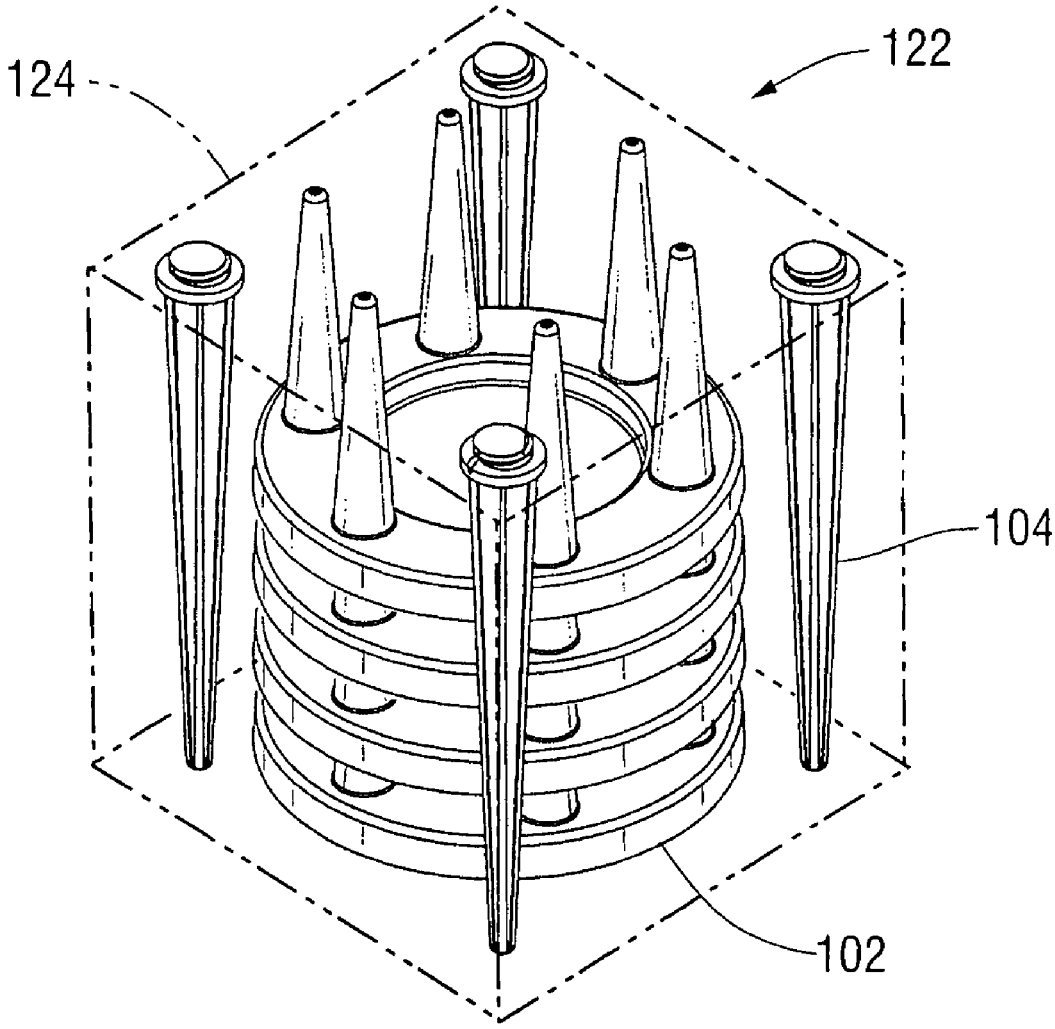
FIG. 17 a perspective view of a packaged product including four of the cup holders of FIG. 14.

FIG. 17 is a perspective view of a product 122, packaged for sale within a box indicated by dashed lines 124, including four stacked base portions 102 and four ground attachment elongated members 104.

It is understood that a removably attached ground attachment elongated member 104, as described above in reference to FIGS. 14-16, and the optional features described above in reference to FIG. 6, may be applied individually or in combination to the second and third embodiments of the invention. While the invention has been described in terms of its preferred versions or embodiments with some degree of particularity, it is understood that this description has been given merely as an example, and that numerous changes can be made without departing from the spirit and scope of the invention, as defined in the appended claims.

What is claimed is:

1. A packaged product comprising:

a stack of cup holders, wherein each of the cup holders comprises:

a base having a lower surface, an upper surface, and a central hole, wherein the upper surface includes a central cup-receiving portion and a peripheral portion extending around the central cup-receiving portion;

a plurality of cup holding elongated members extending upward from the peripheral portion; and a plurality of openings in the lower surface for receiving cup holding elongated members of a cup holder disposed below the cup holding apparatus, wherein each of the cup holding elongated members of each of the cup holders below a top cup holder within the stack extends within one of the openings in the lower surface of a cup holder above the cup holding elongated member; and a plurality of ground attachment elongated members, each removably attachable within the central hole in the base of one of the cup holders to extend downward from the lower surface thereof.

2. The packaged product of claim 1, wherein the base of each of the cup holders includes a central threaded hole extending upward from the lower surface, and each of the ground attachment elongated members includes a threaded cylindrical portion configured to engage the central threaded hole in the base of one of the cup holders.

3. The packaged product of claim 1, wherein each of the openings in the lower surface extends upward within one of the cup holding elongated members, each of the cup holding elongated members includes one of the openings in the lower surface, each of the cup holding elongated members is tapered to a smaller end at its top, and each of the openings in the lower surface is tapered to a smaller end at its top.

4. The packaged product of claim 1, wherein the central cup-receiving portion is circular, the plurality of cup holding elongated members are arranged in a circular pattern, and the plurality of openings in the lower surface are arranged in the circular pattern to receive cup holding elongated members arranged in the circular pattern within the cup holder disposed below the cup holding apparatus.

5. The packaged product of claim 4, wherein the cup holding elongated members are arranged along the base in a first pattern, the openings in the lower surface are arranged in a plurality of patterns, each of the patterns in the plurality of patterns is similar to the first pattern, and each of the patterns in the plurality of patterns is displaced from the first pattern and from each of the other patterns within the plurality of patterns the central cup-receiving portion is circular, the first pattern is a circular pattern, and each of the patterns in the plurality of patterns is disposed coaxially with the first pattern.

6. The packaged product of claim 5, wherein each of the cup holding elongated members is tapered from a larger end at the base to a smaller end at the top of the cup holding elongated member, each of the openings in the lower surface is configured to fit on a member similar to each of the cup holding elongated members at a level displaced from the base between the smaller end and the larger end.

7. The packaged product of claim 5, wherein each of the cup holding elongated members is smaller than each of the openings in the lower surface.

* * * * *